US009188935B2

(12) United States Patent
Nishimura

(10) Patent No.: US 9,188,935 B2
(45) Date of Patent: Nov. 17, 2015

(54) IMAGE FORMING APPARATUS

(71) Applicant: Brother Kogyo Kabushiki Kaisha, Nagoya-shi, Aichi-ken (JP)

(72) Inventor: Yohei Nishimura, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/305,040

(22) Filed: Jun. 16, 2014

(65) Prior Publication Data

US 2014/0376943 A1 Dec. 25, 2014

(30) Foreign Application Priority Data

Jun. 20, 2013 (JP) ..... 2013-129807

(51) Int. Cl.

| | |
|---|---|
| ***G03G 15/00*** | (2006.01) |
| ***G03G 21/18*** | (2006.01) |
| ***G03G 15/01*** | (2006.01) |
| ***G03G 21/16*** | (2006.01) |

(52) U.S. Cl.

CPC ..... *G03G 15/80* (2013.01); *G03G 15/0178* (2013.01); *G03G 21/1652* (2013.01); *G03G 21/1853* (2013.01); *G03G 15/0194* (2013.01); *G03G 21/1867* (2013.01)

(58) Field of Classification Search

CPC ..... G03G 15/80; G03G 21/1652; G03G 2221/166; G03G 2221/1684

USPC ..... 399/88, 89, 90, 110

See application file for complete search history.

(56) References Cited

U.S. PATENT DOCUMENTS

| | | | |
|---|---|---|---|
| 4,903,452 | A | 2/1990 | Huang |
| 5,208,612 | A | 5/1993 | Obu et al. |
| 6,069,646 | A | 5/2000 | Okabe et al. |
| 6,208,817 | B1 | 3/2001 | Chadani et al. |
| 7,567,769 | B2 | 7/2009 | Noguchi et al. |

(Continued)

FOREIGN PATENT DOCUMENTS

| | | | |
|---|---|---|---|
| JP | S55-3546 | U | 1/1980 |
| JP | H10-161507 | A | 6/1998 |

(Continued)

OTHER PUBLICATIONS

U.S. Appl. No. 14/541,910, filed Nov. 14, 2014.

(Continued)

*Primary Examiner* — Erika J Villaluna

(74) *Attorney, Agent, or Firm* — Banner & Witcoff, Ltd.

(57) ABSTRACT

An image forming apparatus, including at least three image forming units, a substrate, a frame to support the image forming units and the substrate, and a plurality of spring electrodes, is provided. The plurality of spring electrodes includes a first spring electrode, a second spring electrode, and a third spring electrode configured to serve a common function and arranged to align along an aligning direction, which is orthogonal to rotation axes of photosensitive drums in the image forming units. The frame includes a pair of supporting parts arranged along the aligning direction to support the substrate. A distance between the second spring electrode and the third spring electrode is greater than a distance between the first spring electrode and the second spring electrode. A center between the pair of supporting parts is located in a position between the second spring electrode and the third spring electrode.

15 Claims, 7 Drawing Sheets

(56) References Cited

U.S. PATENT DOCUMENTS

| | | | | |
|---|---|---|---|---|
| 7,706,716 | B2 | 4/2010 | Tada et al. | |
| 7,783,226 | B2 | 8/2010 | Tomatsu | |
| 7,894,743 | B2 | 2/2011 | Tomatsu | |
| 8,175,491 | B2 | 5/2012 | Tomatsu et al. | |
| 8,244,153 | B2 | 8/2012 | Nakashima | |
| 8,428,486 | B2 | 4/2013 | Abe et al. | |
| 8,532,524 | B2 | 9/2013 | Souda | |
| 8,611,790 | B2 | 12/2013 | Souda | |
| 8,706,001 | B2 | 4/2014 | Yamauchi et al. | |
| 8,948,680 | B2 | 2/2015 | Nishimura | |
| 2003/0177999 | A1 | 9/2003 | Saito et al. | |
| 2007/0160382 | A1 | 7/2007 | Tomatsu | |
| 2008/0075502 | A1 | 3/2008 | Tada et al. | |
| 2008/0159773 | A1* | 7/2008 | Murayama et al. | 399/90 |
| 2008/0159781 | A1 | 7/2008 | Noguchi et al. | |
| 2010/0014887 | A1 | 1/2010 | Tomatsu et al. | |
| 2010/0080612 | A1 | 4/2010 | Nakashima | |
| 2010/0135689 | A1 | 6/2010 | Abe et al. | |
| 2011/0102983 | A1 | 5/2011 | Souda et al. | |
| 2011/0129276 | A1 | 6/2011 | Kondo | |
| 2011/0170932 | A1 | 7/2011 | Bhatia et al. | |
| 2011/0262173 | A1* | 10/2011 | Souda | 399/89 |
| 2012/0038091 | A1 | 2/2012 | Tagawa | |
| 2013/0004198 | A1 | 1/2013 | Tomatsu | |
| 2013/0004199 | A1 | 1/2013 | Souda et al. | |
| 2013/0077990 | A1 | 3/2013 | Nakashima | |
| 2013/0170857 | A1 | 7/2013 | Souda et al. | |
| 2014/0376944 | A1 | 12/2014 | Souda et al. | |
| 2014/0376945 | A1 | 12/2014 | Souda et al. | |
| 2014/0376946 | A1 | 12/2014 | Souda et al. | |
| 2014/0376957 | A1 | 12/2014 | Souda et al. | |
| 2014/0376958 | A1 | 12/2014 | Souda et al. | |

FOREIGN PATENT DOCUMENTS

| | | | |
|---|---|---|---|
| JP | 2000-177202 | A | 6/2000 |
| JP | 2000-352921 | A | 12/2000 |
| JP | 2003-278739 | A | 10/2003 |
| JP | 2003-343541 | A | 12/2003 |
| JP | 2004-068862 | A | 3/2004 |
| JP | 2004-151510 | A | 5/2004 |
| JP | 2005-037652 | A | 2/2005 |
| JP | 2006-239876 | A | 9/2006 |
| JP | 2007-148142 | A | 6/2007 |
| JP | 2008-065122 | A | 3/2008 |
| JP | 2008-165027 | A | 7/2008 |
| JP | 2010-026152 | A | 2/2010 |
| JP | 2010-044363 | A | 2/2010 |
| JP | 2010-079046 | A | 4/2010 |
| JP | 2010-128337 | A | 6/2010 |
| JP | 2011-232513 | A | 11/2011 |
| JP | 2013-137426 | A | 7/2013 |

OTHER PUBLICATIONS

U.S. Appl. No. 14/582,753, filed Dec. 24, 2014.
U.S. Appl. No. 14/582,630, filed Dec. 24, 2014.
U.S. Appl. No. 14/582,715, filed Dec. 24, 2014.
U.S. Appl. No. 14/582,720, filed Dec. 24, 2014.
Jun. 11, 2015—(US) Ex Parte Quayle Office Action—U.S. Appl. No. 14/582,753.
Jun. 26, 2015—(US) Notice of Allowance—U.S. Appl. No. 14/541,910.
Jul. 2, 2015—(US) Non-Final Office Action—U.S. Appl. No. 14/582,630.
Feb. 18, 2015—(US) Notice of Allowance—U.S. Appl. No. 14/305,351.
Feb. 24, 2015—(US) Non-Final Office Action—U.S. Appl. No. 14/305,046.
Mar. 5, 2015—(US) Notice of Allowance—U.S. Appl. No. 14/305,093.
Apr. 9, 2015—(US) Non-Final Office Action—U.S. Appl. No. 14/305,083.
Apr. 13, 2015—(US) Ex Parte Quayle Office Action—U.S. Appl. No. 14/305,068.
Jul. 24, 2015—(US) Notice of Allowance—U.S. Appl. No. 14/305,351.

* cited by examiner

IMAGE FORMING APPARATUS

CROSS REFERENCE TO RELATED APPLICATION

This application claims priority from Japanese Patent Application No. 2013-129807 filed on Jun. 20, 2013, the entire subject matter of which is incorporated herein by reference.

BACKGROUND

1. Technical Field

An aspect of the present invention relates to an image forming apparatus having a plurality of image forming units and a substrate to supply power to the image forming units.

2. Related Art

An image forming apparatus having a plurality of processing units arranged to align in line is known. The image forming apparatus may include a substrate to feed power to the processing units, and a plurality of spring electrodes to transmit the power. The substrate may be arranged on one side of the processing units, and the plurality of spring electrodes may be arranged in positions between the processing units and the substrate in a compressed condition. Among the plurality of spring electrodes, some of the spring electrodes serving a common function, such as spring electrodes for supplying electricity to electric chargers in the processing units, may be arranged to be evenly spaced apart from one another along an aligning direction of the processing units.

SUMMARY

In the image forming apparatus mentioned above, some of the evenly-spaced spring electrodes may be arranged in positions in a central area of the substrate. Therefore, due to the compressed condition of such spring electrodes, force to urge the substrate in a direction orthogonally to a planar face of the substrate may be caused and applied to the central area of the substrate. In this regard, the substrate may be deformed to bow at the central area.

The present invention is advantageous in that an image forming apparatus, in which deformation of the substrate can be restrained, is provided.

According to an aspect of the present invention, an image forming apparatus is provided. The image forming apparatus includes at least three image forming units, each of which includes a photosensitive drum configured to be rotatable about a rotation axis, the at least three image forming units being arranged to locate the photosensitive drums thereof to align along an aligning direction, which is orthogonal to the rotation axes of the photosensitive drums; a substrate arranged on one side of the at least three image forming units in an axial direction of the rotation axes of the photosensitive drums, the substrate being configured to supply electricity to the at least three image forming units; a frame configured to support the at least three image forming units and the substrate; and a plurality of spring electrodes, each of which is provided to one of the at least three image forming units respectively, each of the plurality of spring electrodes being arranged in a position between the respective one of the at least three image forming units and the substrate in a compressed condition. The plurality of spring electrodes includes a first spring electrode, a second spring electrode arranged to adjoin the first spring electrode, and a third spring electrode arranged to adjoin the second spring electrode on a side opposite from the first spring electrode across the second spring electrode. The first spring electrode, the second spring electrode, and the third spring electrode are configured to serve a common function and are arranged to align along the aligning direction. The frame includes a pair of supporting parts, each of which is arranged on one and the other sides of the plurality of spring electrodes along the aligning direction respectively, the pair of supporting parts being configured to support the substrate. A distance between the second spring electrode and the third spring electrode is greater than a distance between the first spring electrode and the second spring electrode. A center between the pair of supporting parts is located in a position between the second spring electrode and the third spring electrode.

BRIEF DESCRIPTION OF THE ACCOMPANYING DRAWINGS

DETAILED DESCRIPTION

Hereinafter, a configuration of a color printer 1 according to an embodiment of the present invention will be described with reference to the accompanying drawings. First, an overall configuration of the color printer 1 will be described, and second, specific components in the color printer 1 will be described in detail.

Figure 1:
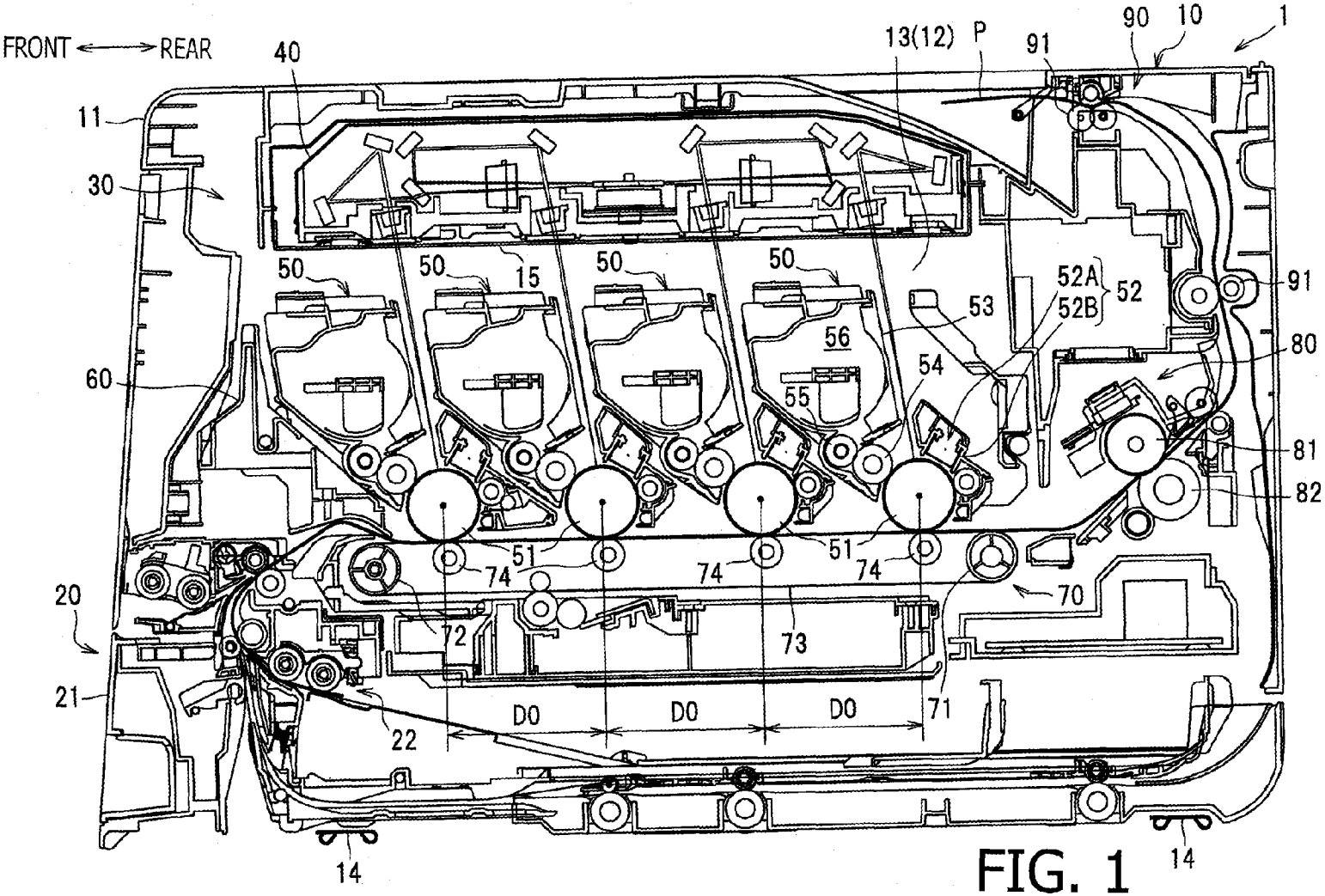
FIG. 1 is a cross-sectional side view of a color printer according to an embodiment of the present invention.

In the following description, directions concerning the color printer 1 will be referred to in accordance with orientation indicated by arrows in each drawing. Therefore, for example, a viewer's left-hand side appearing in FIG. 1 is referred to as a front side of the color printer 1, and a right-hand side in FIG. 1 opposite from the front side is referred to as a rear side. A side which corresponds to the viewer's nearer side is referred to as a right-hand side for a user, and an opposite side from the right, which corresponds to the viewer's farther side is referred to as a left-hand side for the user. An up-down direction in FIG. 1 corresponds to a vertical direction of the color printer 1. Further, the right-to-left or left-to-right direction of the color printer 1 may be referred to as a widthwise direction, and the front-to-rear or rear-to-front direction may be referred to as a direction of depth. The widthwise direction and the direction of depth are orthogonal to each other. Directions of the drawings in FIGS. 2-7 are similarly based on the orientation of the color printer 1 as defined above and correspond to those with respect to the color printer 1 shown in FIG. 1 even when the objects are viewed from different angles.

The color printer 1 includes a sheet-feeder unit 20, an image forming device 30, and an ejection unit 90, which are arranged inside a body 10. The sheet-feeder unit 20 is configured to feed a sheet P in the body 10, the image forming device 30 is configured to form an image on the sheet P being fed, and the ejection unit 90 is configured to eject the sheet P with the image formed thereon outside. A configuration of the body 10 of the color printer 1 will be described later in detail.

The sheet-feeder unit 20 includes a sheet-feed tray 21 to store the sheet P therein and a sheet conveyer 22 to convey the sheet P from the sheet-feed tray 21 to the image forming device 30.

The image forming device 30 includes an optical scanner 40, a plurality of (e.g., four) processing units 50, a drawer 60, a transfer unit 70, and a fixing unit 80.

The optical scanner 40 is arranged in an upper position with respect to the plurality of processing units 50 in the body 10. The optical scanner 40 includes a laser-beam emitter (not shown), a plurality of polygon mirrors (unsigned), lenses (unsigned), and a plurality of reflection minors (unsigned). Laser beams emitted from the laser-beam emitter for a plurality of (e.g., four) colors are reflected on the polygon minors and the reflection mirrors and transmit through the lenses to scan surfaces of photosensitive drums 51 in the processing units 50.

The processing units 50 are arranged to align at evenly spaced intervals in line, along a direction of depth (i.e., a front-rear direction) of the color printer 1, i.e., orthogonally to the axial direction of rotation axes of the photosensitive drums 51. In particular, intervals D0 between adjoining two photosensitive drums 51 along an aligning direction of the photosensitive drums 51 are equal. Each of the processing units 50 includes the photosensitive drum 51, which is rotatable about a rotation axis thereof extending along the widthwise direction, a charger 52 to electrically charge the photosensitive drum 51, and a developer cartridge 53. Each charger 52 includes a charging wire 52A and a grid electrode 52B to charge the photosensitive drum 51. Each developer cartridge 53 includes a developer roller 54 to supply a developer agent (e.g., toner) to the photosensitive drum 51 and a toner container 56 to store the toner therein. All the processing units 51 are configured similarly but different from one another in colors of the toner contained in the toner containers 56.

Figure 2:
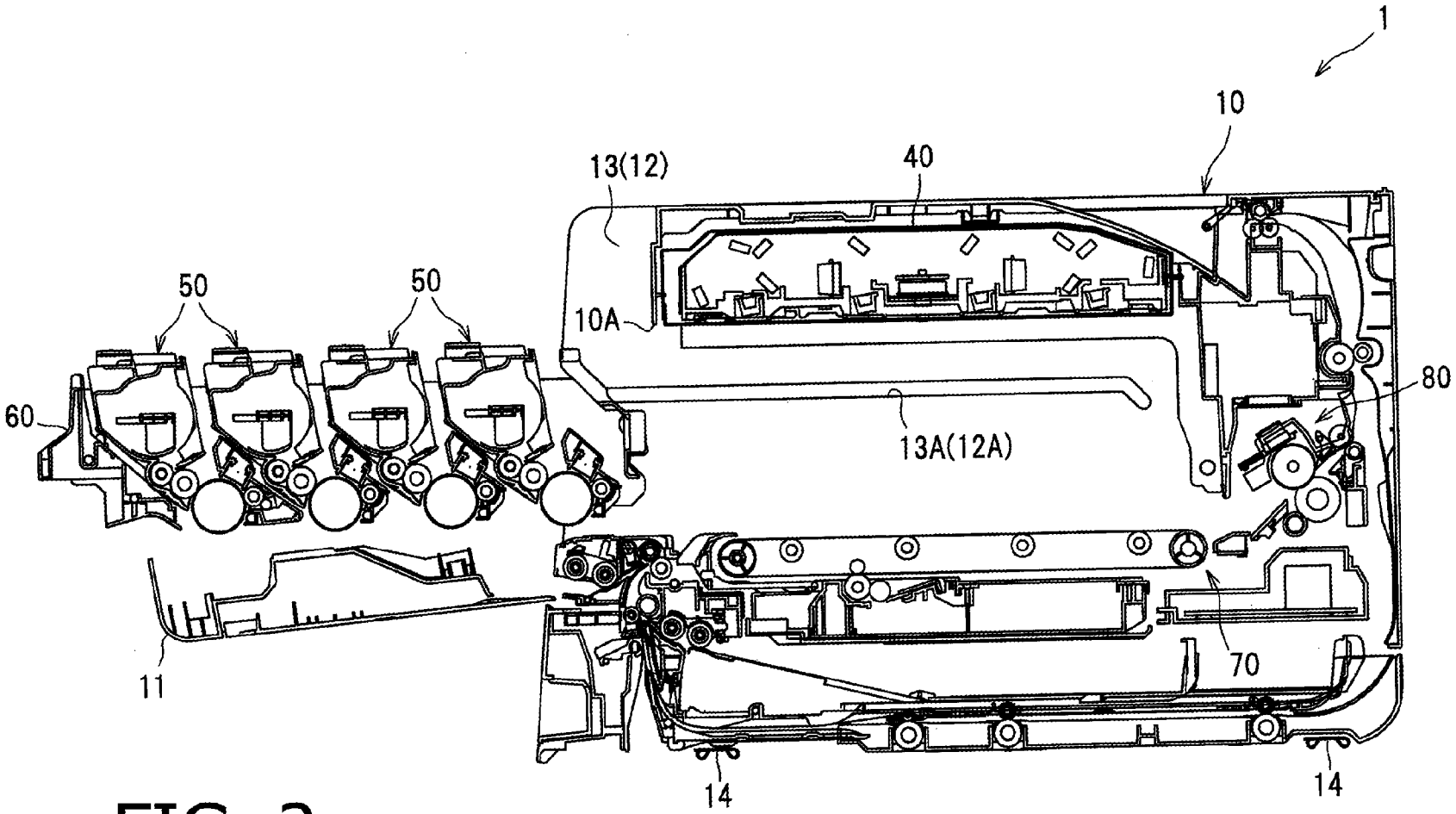
FIG. 2 is a cross-sectional side view of the color printer with a drawer being drawn out of a body of the color printer according to the embodiment of the present invention.

The drawer 60 supports the plurality of processing units 50 and is movable along the front-rear direction with respect to a pair of side frames 12, 13, which form lateral walls of the body 10 of the color printer 1. Each of the side frames 12, 13 is provided with a rail 12A, 13 (see FIG. 2), so that the drawer 60 is guided by the rails 12A, 13A to move frontward or rearward along the front-rear direction. As shown in FIG. 2, the drawer 60 can be drawn out of the body 10 of the color printer 10 through an opening 10A, which is exposed when a front cover 11 arranged on the front side of the body 10 is opened. Thus, the processing units 50 are exposed to the outside atmosphere.

Referring back to FIG. 1, the transfer unit 70 is arranged in a position between the sheet-feeder unit 20 and the drawer 60. The transfer unit 70 includes a driving roller 71, a driven roller 72, a conveyer belt 73, and transfer rollers 74. The driving roller 71 and the driven roller 72 are arranged to extend axially in parallel with each other in spaced-apart positions from each other along the front-rear direction so that the conveyer belt 73 being an endless belt is strained to roll around the driving roller 71 and the driven roller 72. The conveyer belt 73 is arranged to have an upper outer surface thereof to be in contact with the photosensitive drums 51. A plurality of (e.g., four) transfer rollers 74 are arranged in positions opposite from the photosensitive drums 51 across the conveyer belt 73, and the conveyer belt 73 is in contact with the transfer rollers 74 at an upper inner surface thereof. Transfer bias under constant current control is applied to the transfer rollers 74 to transfer an image from the photosensitive drums 51 to the sheet P.

The fixing unit 80 is arranged in a rear position with respect to the processing units 50 and includes a heat roller 81 and a pressure roller 82. The pressure roller 82 is arranged in a position to face the heat roller 81 and is urged against the heat roller 81.

In each of the processing units 50 in the image forming device 30 configured as above, the charger 52 electrically charges a surface of the photosensitive drum 51 evenly, and the surface of the photosensitive drum 51 is exposed to the laser beam emitted selectively based on image data from the optical scanner 40 in order to form a lower-potential regions, i.e., an electrostatic latent image representing the image to be formed on the sheet P, thereon. Thereafter, the toner is supplied to the latent image on the photosensitive drum 51 from the developer cartridge 53 through the developer roller 54. Thus, the latent image is developed to be a toner image and carried on the surface of the photosensitive drum 51.

When the sheet P supplied from the sheet-feeder unit 20 is carried on the conveyer belt 73 to a position between the photosensitive drum 51 and the transfer roller 74, the toner image formed on the surface of the photosensitive drum 51 is transferred onto the sheet P. Thus, four colored images are sequentially overlaid on the surface of the sheet P to form a colored image. The sheet P with the transferred toner images is carried to a nipped position between the heat roller 81 and the pressure roller 82 in the fixing unit 80 to have the toner images thermally fixed thereon.

The ejection unit 90 includes a plurality of conveyer rollers 91 to convey the sheet P. The sheet P with the fixed image is ejected out of the body 10 of the color printer 1 by the conveyer rollers 91.

Detailed Configuration of the Color Printer

Figure 3:
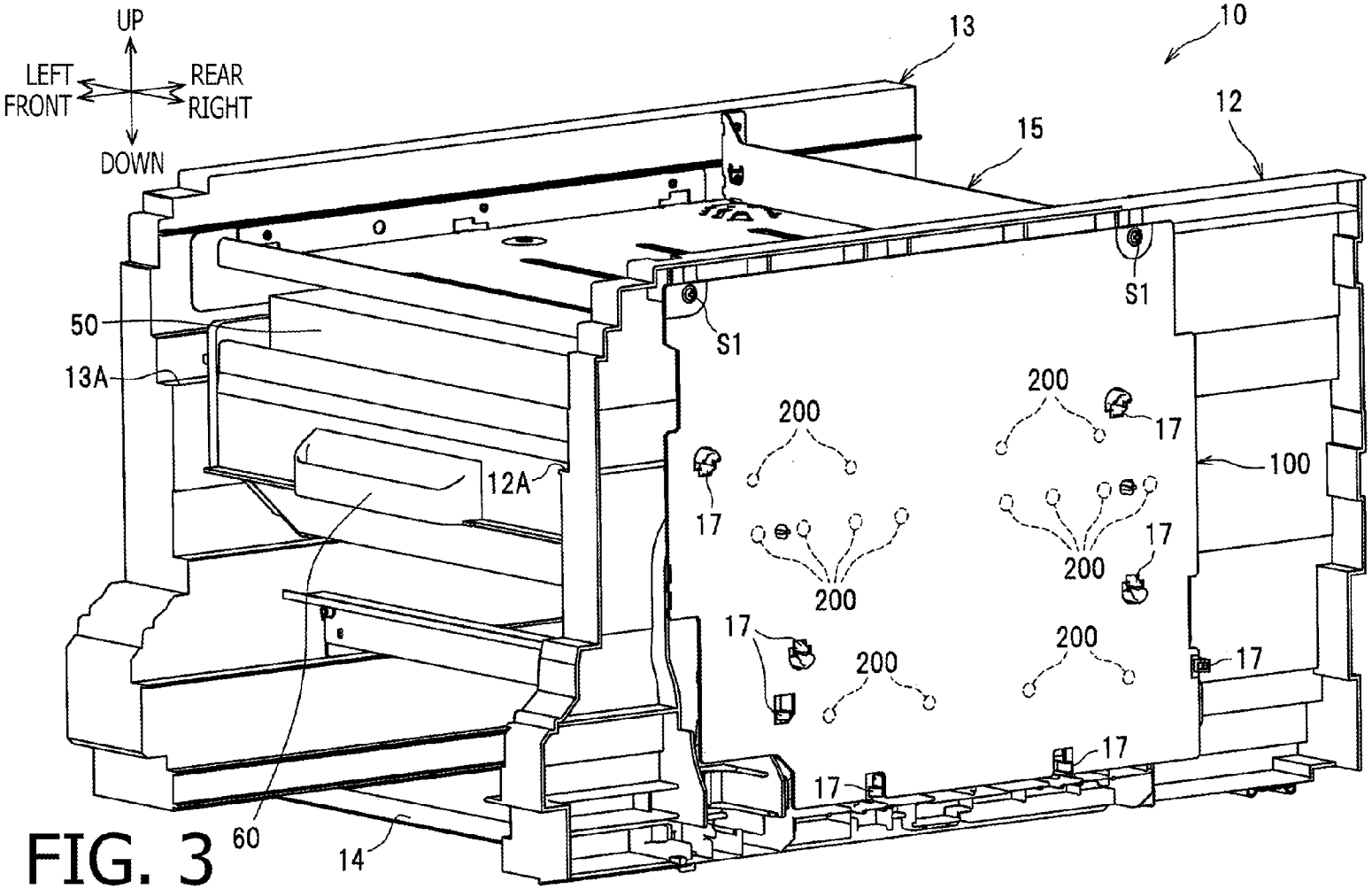
FIG. 3 is a perspective view of the body of the color printer according to the embodiment of the present invention.

As shown in FIG. 3, the color printer 1 includes a substrate 100 and a plurality of spring electrodes 200. The substrate 100 is a power board to feed electrical power to electrically movable components in the image forming device 30, such as the processing units 50 and the transfer unit 70. The substrate 100 is arranged on a right-hand side of the processing units 50 along the widthwise direction. The spring electrodes 200 are electrodes to conduct the electricity from the substrate 100 to the image forming device 30. Detailed configuration and arrangement of the spring electrodes 200 will be described later.

The body 10 of the color printer 1 includes paired side frames 12, 13, which are arranged on a right-hand side and a left-hand side of the color printer 1 respectively. The body 10 includes lower beams 14 to connect lower ends of the side frames 12, 13, and a scanner-supporting plate 15, which connects upper ends of the side frames 12, 13.

The side frames 12, 13 are resin plates, each of which is formed to have an approximate shape of a flat rectangle, and are arranged on the right side and the left side in the color printer 1 facing each other across the drawer 60 to support the drawer 60. In other words, while the drawer 60 supports the processing units 50, the side frames 12, 13 support the processing units 50 via the drawer 60.

The lower beams 14 are elongated metal bars extending along the widthwise direction. As shown in FIGS. 1 and 3, one of the lower beams 14 is arranged on the front side of the side frames 12, 13, and another one of the lower beams 14 is arranged on the rear side of the side frames 12, 13. The scanner-supporting plate 15 enhances the side frames 12, 13 and supports the optical scanner 40. The scanner-supporting plate 15 is formed of a bended metal sheet.

In the present embodiment, one of the side frames 12, 13 arranged on the right-hand side supports the right-hand side of the drawer 60. The side frame 12 supports the substrate 100 likewise. In particular, the side frame 12 is formed to have two (2) fixing parts 16 (see FIG. 4) on a right-side face thereof, which is an opposite side from a left-hand side where the processing units 50 are arranged. In the fixing parts 16, screws S1 to fix the substrate 100 to the side frame 12 are screwed. The side frame 12 is formed to have a plurality of engageable parts 17, which are engageable with the substrate 100.

Figure 4:
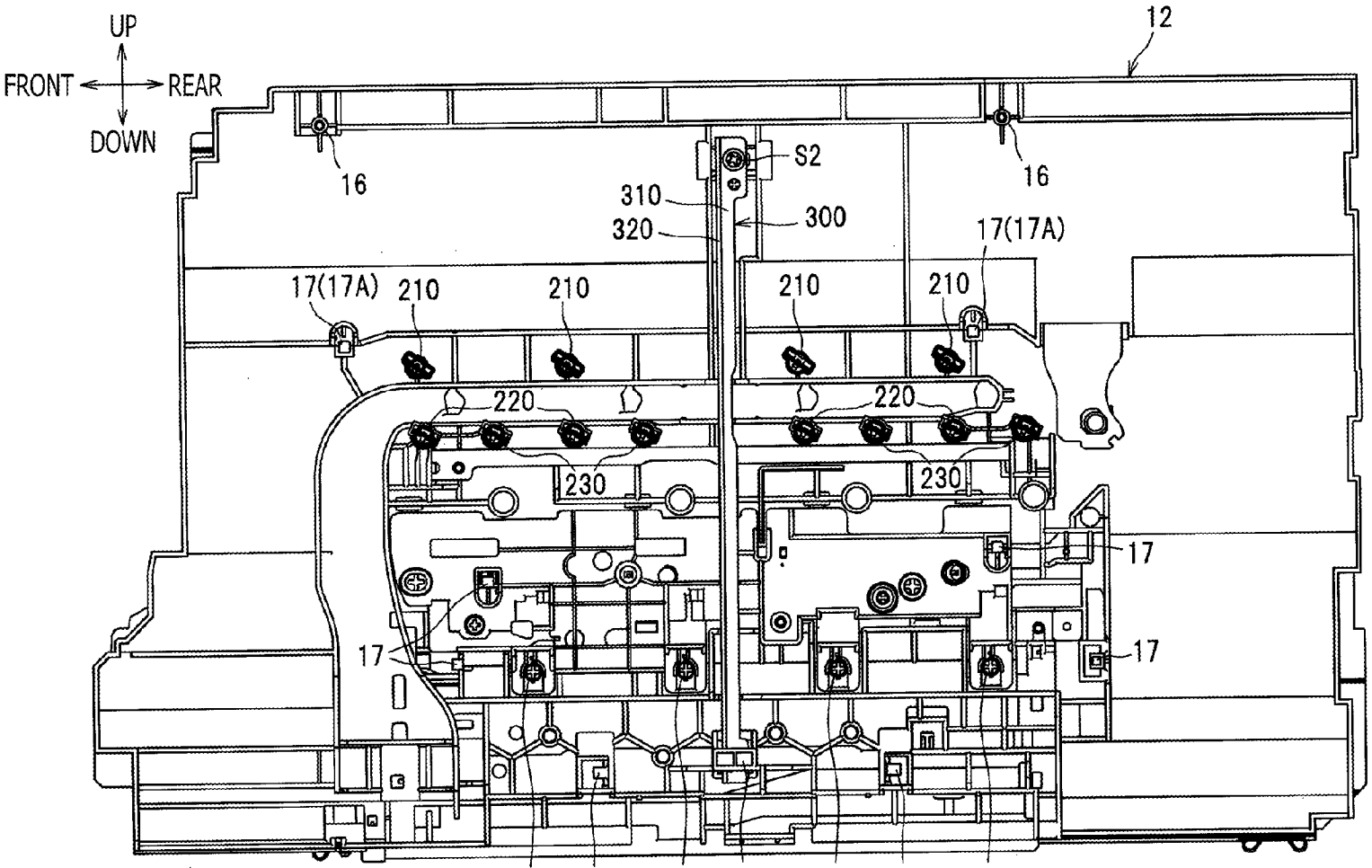
FIG. 4 is a lateral view of a side frame on the right in the color printer according to the embodiment of the present invention
Figure 5:
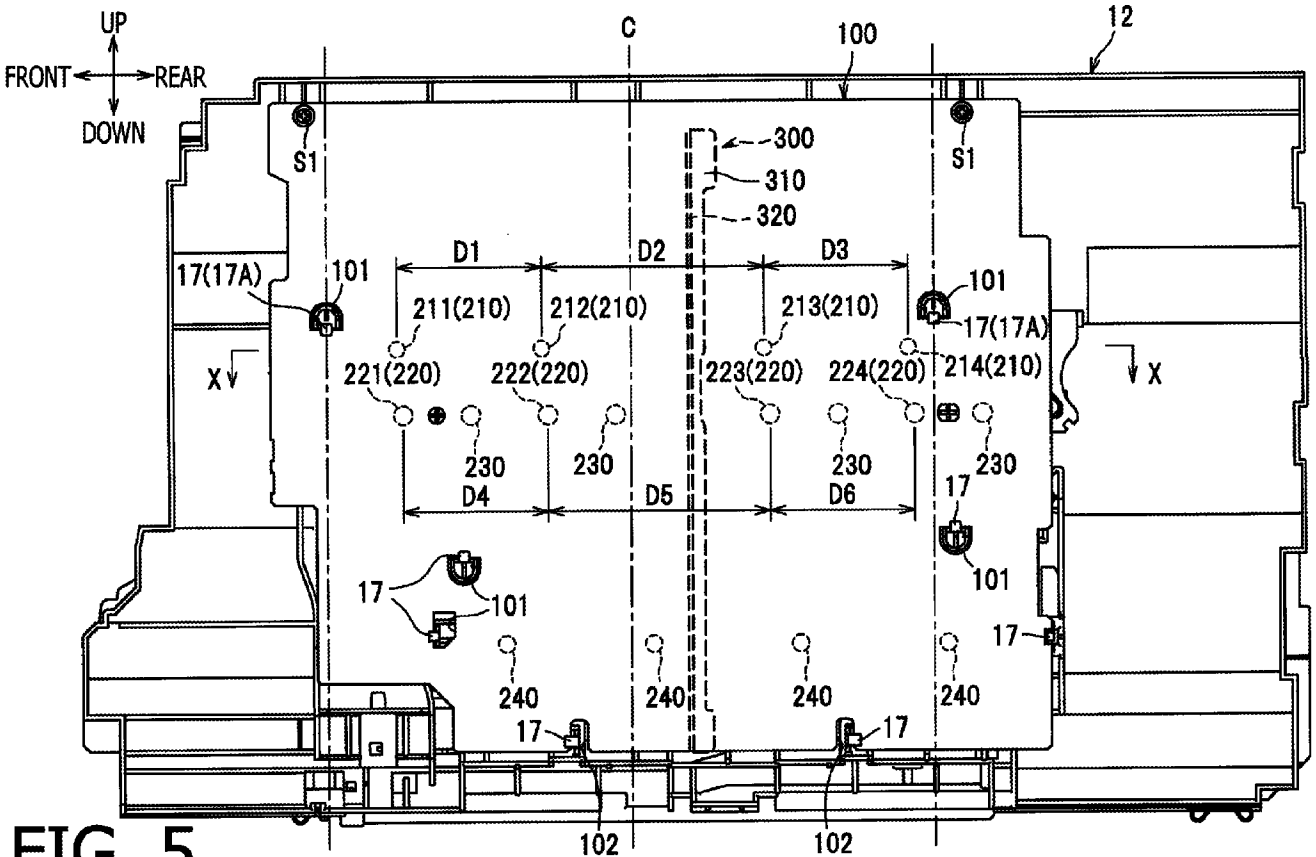
FIG. 5 is a lateral view of the side frame on the right and a substrate attached thereto according to the embodiment of the present invention viewed from the right side along the widthwise direction.

As shown in FIGS. 4 and 5, the fixing parts 16 are formed in positions corresponding to upper-front and upper-rear ends of the substrate 100 to be spaced apart from each other along the front-rear direction on an upper edge of the side frame 12. Each of the fixing parts 16 is formed in a shape of a tube, in which the screw S1 can be screwed.

Figure 6:
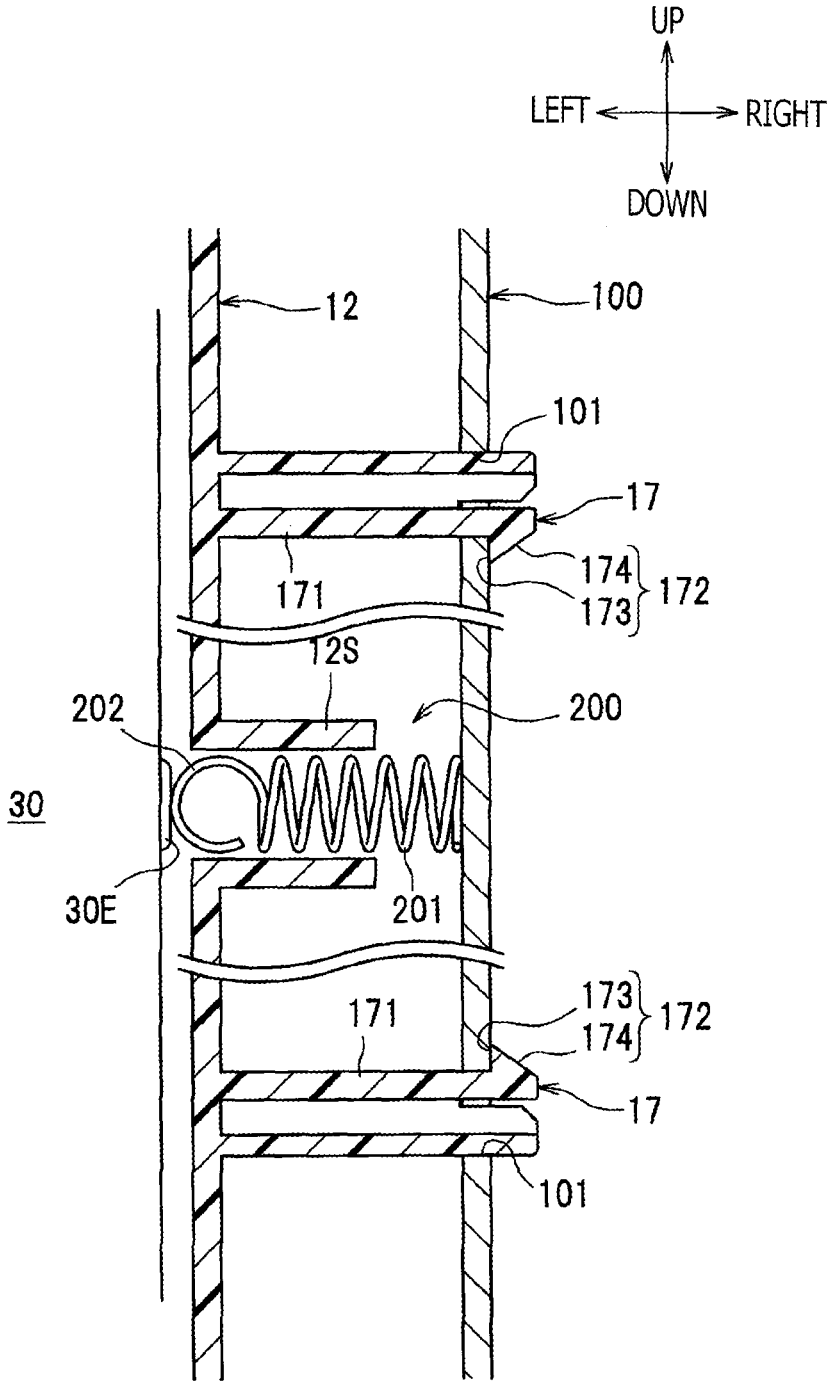
FIG. 6 is a cross-sectional view of the side frame on the right with the spring electrodes and the substrate attached thereto in the color printer according to the embodiment of the present invention.

The plurality of engageable parts 17 include four (4) pairs of engageable parts 17, which are formed in positions corresponding to vertically central area in the substrate 100, between an upper end and a lower end of the substrate 100, and in positions corresponding to a lower end of the substrate 100. The engageable parts 17 in each pair are formed in positions spaced apart from each other along the front-rear direction. As shown in FIG. 6, each engageable part 17 includes a jut 171 and a claw 172. The jut 171 projects rightward from a right-hand surface of the side frame 12 and is deformable. The claw 172 projects from a rightward tip end of the jut 171 in a direction orthogonal to the widthwise direction. The claw 172 includes a supporting face to support the substrate 100 and a slope face 174, which inclines from an outer end of the supporting face 173 toward the tip end of the jut 171.

Each of the spring electrodes 200 is formed to have a compression coiled spring 201 and a terminal 202, which is formed in a shape of a ring at one end of the compression coiled spring 201, integrally. The spring electrode 200 is fitted in a spring support 12S, which is formed in the side frame 12 to have a tubular shape, to be supported by the side frame 12. The spring electrode 200 is arranged to have the terminal 202 to be in contact with an electrode 30E, which is arranged on a side of the image forming device 30, to be electrically connected with the electrode 30E. Meanwhile, a right-hand end of the compression coiled spring 200 is arranged to be in contact with an electrode (not shown), which is arranged on the substrate 100, to be electrically connected therewith. Thus, the compression coiled springs 200 are arranged in intermediate positions between the substrate 100 and the processing units 50 in the image forming device 30.

The electrodes 30E on the image forming device 30 are electrically connected with the spring electrodes 200 when the drawer 60 is installed in the body 10 of the color printer 1 and the terminals 202 in the spring electrodes 200 contact the electrodes 30E on the image forming device 30. In this regard, force directed orthogonally with respect to a planar surface of the substrate 100, i.e., along the widthwise direction, is caused by resiliency of the compression coiled springs 201, and the electrodes (not shown) on the substrate 100 are subject to the load from the compression coiled springs 201.

The spring electrodes 200 include, as shown in FIG. 4, wire-electrodes 210, developer-electrodes 220, grid-electrodes 230, and transfer-electrodes 240. The wire-electrodes 210 are electrodes to supply electricity to the charging wires 52A. The developer-electrodes 220 are electrodes to supply electricity to the developer cartridges 53. The grid-electrodes 230 are electrodes to supply electricity to the grid electrodes 52B. The transfer-electrodes 240 are electrodes to supply electricity to the transfer rollers 74. Each of the wire-electrodes 210, the developer-electrodes 220, the grid-electrodes 230, the transfer-electrodes 240 are provided to one of the four processing units 50 or to one of the four transfer rollers 74 respectively. In other words, there are four (4) wire-electrodes 210, four (4) developer-electrodes 220, four (4) grid-electrodes, and four (4) transfer-electrodes 240, each of which is provided on one-to-one basis to either one of the processing units 50 or to one of the transfer rollers 74.

The four wire-electrodes 210 are provided to serve a common function: to supply electricity to the charging wires 52A in the processing units 50. As shown in FIG. 5, the four wire-electrodes 210 include a first wire-electrode 211, a second wire-electrode 212, a third wire-electrode 213, and a fourth wire-electrode 214, which are arranged to align in line along the front-to-rear direction, in the order being mentioned above. In this regard, a distance D1 between the first wire-electrode 211 and the second wire-electrode 212 is substantially equivalent to a distance D3 between the third wire-electrode 213 and the fourth wire-electrode 214. Meanwhile, a distance D2 between the second wire-electrode 212 and the third wire-electrode 213 is greater than the distance D1 and the distance D3. The distances D1, D3 are smaller than a distance D0 (see FIG. 1) between two adjoining photosensitive drums 51, and the distance D2 is greater than the distance D0.

The four developer-electrodes 220 are provided to serve for a common function: to supply electricity to the developer cartridges 53 A in the processing units 50. More specifically, each of the developer-electrodes 220 supplies electricity to the developer roller 54 and a supplier roller 55 in one of the developer cartridges 53. As shown in FIG. 5, the four developer-electrodes 220 include a first developer-electrode 221, a second developer-electrode 222, a third developer-electrode 223, and a fourth developer-electrode 224, which are arranged to align in line along the front-to-rear direction, in the order being mentioned above. In this regard, a distance D4 between the first developer-electrode 221 and the second developer-electrode 222 is substantially equivalent to a distance D6 between the third developer-electrode 223 and the fourth developer-electrode 224. Meanwhile, a distance D5 between the second developer-electrode 222 and the third developer-electrode 223 is greater than the distance D4 and the distance D6. The distances D4, D6 are smaller than the distance D0 between two adjoining photosensitive drums 51, and the distance D5 is greater than the distance D0.

Among the plurality of engageable parts 17, a pair of engageable parts 17A are arranged in positions closest to the wire-electrodes 210 and the developer-electrodes 220 on the front end and the rear end along the front-rear direction. The pair of engageable parts 17A are arranged such that a center C between the engageable parts 17A along the front-rear direction is located in a position between the second wire-electrode 212 and the third wire-electrode 213, in particular, proximity to a midst position between the second wire-electrode 212 and the third wire-electrode 213 along the front-rear direction. At the same time, the center C between the engageable parts 17A is located in a position between the second developer-electrode 222 and the third developer-electrode 223, in particular, proximity to a midst position between the second developer-electrode 222 and the third developer-electrode 223 along the front-rear direction.

Meanwhile, in the substrate 100, through holes (not shown) are formed in positions corresponding to the fixing parts 16 (see FIG. 4). Further, openings 101 and cutouts 102 are formed in positions corresponding to the plurality of engageable parts 17.

When the substrate 100 is being attached to the side frame 12, the substrate 100 is placed to have the openings 101 and the cutouts 102 aligned with the engageable parts 17 so that the engageable parts 17 are engaged with edges of the openings 101 and the cutouts 102. In this regard, the substrate 100 urges the slope faces 174 (see FIG. 6) of the engageable parts 17, and the juts 171 deform accordingly. Meanwhile, the claws 172 pass through the edges of the openings 101 and the cutouts 102. When the claws 172 penetrate the openings 101 and the cutouts 102, the juts 171 recover from the deformed shapes, and the claws 172 are engaged with the edges of the openings 101 and the cutouts 102 in the substrate 100. Thereafter, the screws S1 are screwed into the through holes in the substrate 100 so that the substrate 100 is fixed to the side frame 12.

While the spring electrodes 200 are in the compressed condition in the positions between the image forming device 30 and the substrate 100, the substrate 100 is urged against the supporting faces 173 of the engageable parts 17 due to the resiliency of the spring electrodes 200, and thus, the substrate 100 is supported by the supporting faces 173 of the engageable parts 17. In the present embodiment, while each spring electrode 200 includes the compression coiled spring 201, urging forces produced thereby are fairly distributed along the widthwise direction. Therefore, electrical connection between the substrate 100 and the processing units 50 in the image forming device 300 can be secured.

Figure 7:
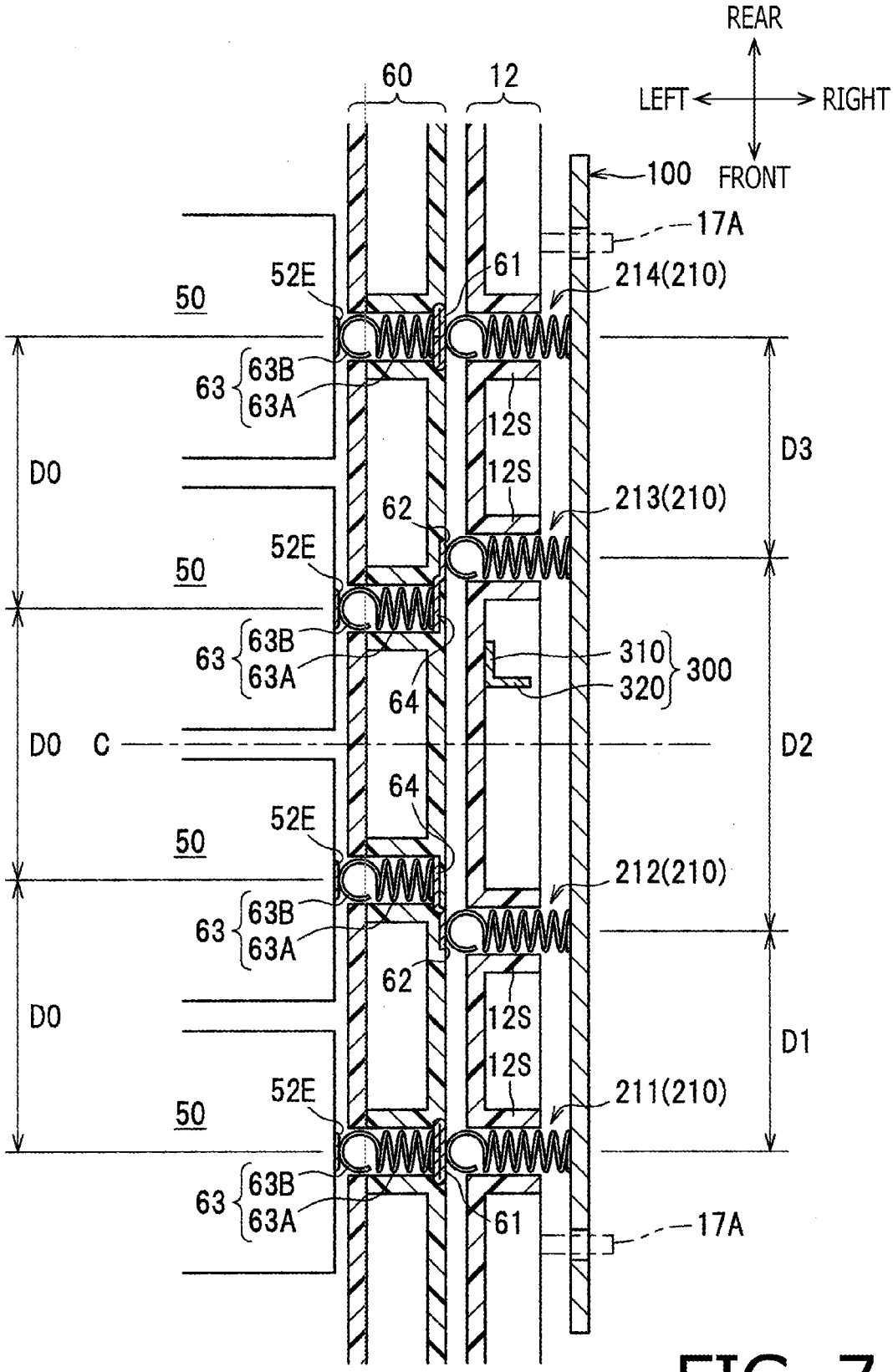
FIG. 7 is a cross-sectional view of the side frame on the right and the substrate attached thereto in the color printer according to the embodiment of the present invention taken along a line X-X shown in FIG. 5.

As shown in FIG. 4, a beam 300 is fixed to a lateral face of the side frame 12, on a same side as the substrate 100. The beam 300 is formed in a shape of an elongated bar longitudinally arranged along the vertical direction, which is orthogonal to the front-rear direction when viewed along the widthwise direction. The beam 300 is a metal bar bent along the longitudinal direction to form a cross-sectional shape of an L. The beam 300 includes, as shown in FIG. 7, a first section 310, which spreads along the right-side face of the side frame 12, and a second section 320, which spreads to rise from a front end of the first section 310 rightward to be apart from the right-side face of the side frame 12.

As shown in FIG. 4, the beam 300 is inserted in an interlocking part 12B, which is formed in a lower area in the side frame 12 in a central position along the front-rear direction, at a lower end thereof. Meanwhile, an upper end of the beam 300 is fastened to the side frame 12 by a screw S2, which is inserted in a through hole (not shown) formed in the upper end of the beam 300. Thus, the beam 300 is fixed to the side frame 12.

By the beam 300 with the rigidity of metal, the resin-made side frame 12 is enhanced at the lateral. In this regard, rigidity of the beam 300 is effectively improved by cross-sectional shape of L. Thus, with the improved rigidity of the beam 300, the resin-made side frame 12 is effectively improved.

While the beam 300 is formed in the shape of the bar having shorter sides and longer sides in the lateral view along the widthwise direction, the shorter sides align with the front-rear direction of the side frame 12, and a dimension of the shorter sides is substantially smaller with respect to a dimension of the side frame 12 along the front-rear direction. In particular, the dimension of the shorter sides of the beam 300 along the front-rear direction is approximately at most 1/47 of the dimension of the side frame 12 along the front-rear direction. With the substantially smaller dimension with respect to the dimension of the resin-made side frame 12 along the front-rear direction, a weight of the color printer 1 can be reduced to be less compared to, for example, a conventional printer with a side frame consisting of a larger metal plate with planar dimension. The dimension of the beam 300, at a largest part, along the front-rear direction may be between 1/10 and 1/100 with respect to the dimension of a largest part of the side frame 12 along the front-rear direction, and it may even be preferable to set the ratio within a range between 1/40 and 1/50.

As shown in FIGS. 5 and 7, the beam 300 is arranged on the side frame 12 to have the second section 320, which rises outwardly from the right-side face of the side frame 12, to longitudinally extend through the approximately midst position in D2, which is between the second wire-electrode 212 and the third wire-electrode 213, and the approximately midst position in D5, which is between the second developer-electrode 222 and the third developer-electrode 223, while the distances D2 and D5 are longer than the peripheral distances D1, D3 and D4, D6. Therefore, while the second section 320 projects outward to be closer to the second wire-electrodes 212 and the third wire-electrodes 213 compared to the first section 310, the beam 300 can be arranged in the position to secure insulation distances from the second wire-electrodes 212 and the third wire-electrodes 213, or from other spring electrodes 200.

As shown in FIG. 7, in a right-side wall of the drawer 60, arranged are four (4) receiving terminals, which include receiving terminals 61, 62, and four (4) feeding terminals 63 to transmit electricity fed from the substrate 100 through the wire-electrodes 210 to the charging wires 52A in the processing units 50. The receiving terminals 61, 62 are ones of the electrodes 30E (see FIG. 6) arranged on the image forming device 30.

The receiving terminals 61, 62, 62, 61 are arranged to align in line along the front-to-rear direction in the order mentioned above in positions corresponding to the four wire-electrodes 210. In other words, the receiving terminals 62, 62 in the inner positions along the front-rear direction are arranged to be spaced apart from each other at the distance D2, which is greater than the distances D1 and D3 between the receiving terminal 62 in the inner position and the receiving terminal 61 in the outer position along the front-rear direction respectively. The receiving terminals 61, 62 are connected to the corresponding wire-electrodes 210 respectively when the drawer 60 is installed in the body 10 of the color printer 1 and the wire-electrodes 210 contact the receiving terminals 61, 62.

Feeder members 63 are arranged to align at evenly spaced intervals in line, in positions corresponding to the four processing units 50 supported by the drawer 60, along the front-rear direction. In particular, the feeder members 63 are arranged at an interval D0, which is equal to the distance D0 (see FIG. 1) between the rotation axes of two adjoining photosensitive drums 51. Each feeder member 63 is formed to have, similarly to the spring electrodes 200, a compression coiled spring 63A and a ring-shaped terminal 63B integrally. When the terminal 63B contacts a terminal 52E in the corresponding processing unit 50, the feeder member 63 is electrically connected with the terminal 52E. The terminal 52E is conducted to the charging wire 52A in the processing unit 50. In this regard, the terminals 52E are arranged to align in line along the front-rear direction at the interval D0, in the same manner as the feeder members 63.

The feeder members 63 at the front end and the rear end among the four feeder members 63 are arranged to place the rightward ends of the compression coiled springs 63A thereof to be in contact with the receiving terminals 61, and the feeder members 63 are electrically connected with the receiving terminals 61 thereby. Meanwhile, the feeder members 63 in the inner positions along the front-rear direction are arranged to place the rightward ends of the compression coiled springs 63A thereof to be in contact with conductive sheets 64, which are arranged in the wall of the drawer 60. In this regard, the conductive sheet 64 and the receiving terminal 62 are integrally formed of a metal sheet being bended. Thus, the feeder member 63 and the receiving terminal 62 are electrically connected with each other through the conductive sheet 64.

According to the present embodiment, although not shown in the accompanying drawings, electrodes formed similarly to the receiving terminals 61, 62 and the feeder members 63 are provided in the drawer 60 in positions corresponding to the developer-electrodes 220 and the grid-electrodes 230.

According to the color printer 1 described above, as shown in FIG. 5, among the plurality of engageable parts 17, the pair of engageable parts 17A formed in positions closest to the wire-electrodes 210 and the developer-electrodes 220 on the front end and the rear end along the front-rear direction are arranged such that the center C between the engageable parts 17A is located in proximity to the midst position between the second wire-electrode 212 and the third wire-electrode 213 and to the midst position between the second developer-electrode 22 and the third developer electrode 223. In other words, the wire-electrodes 210 and the developer-electrodes 220 are arranged in positions substantially apart from the center C. Therefore, the central area in the substrate 100 along the front-rear direction can be prevented from being directly subject to the load from the force in the direction orthogonal to the planar face of the substrate 100, which is caused by the wire-electrodes 210, in particular, the second wire-electrode 212 and the second wire-electrode 213 in the inner positions along the front-rear direction. Thus, deformation of the substrate 100 may be restrained.

According to the color printer 1 described above, the wire-electrodes 210 are arranged in unevenly spaced-apart positions along the front-rear direction. In the meantime, the receiving terminals 62 on the drawer 60, which are arranged in the inner-side positions corresponding to the second wire-electrode 212 and the third wire-electrode 213, are electrically connected with the feeder members 63 arranged in the positions corresponding to the terminals 52E on the processing units 50, while the processing units 50 align in evenly spaced-apart positions. In order to establish the electrical connections between the unevenly-spaced receiving terminals 62 and the evenly-spaced feeder members 63, the intermediate conductive sheets 64 to connect the receiving terminals 62 with the feeder members 63 are provided in the drawer 60. Therefore, it is not necessary to modify the arrangement of the electrodes 52E or the processing units 50 in order to establish the electrical connection there-between. Therefore, the processing units 50 are identically manufactured in a common design.

With the receiving terminals 61, 62 in the drawer 60 being connected with the wire-electrodes 210, the drawer 60 is urged leftward by the wire-electrodes 210. Therefore, the drawer 60 is maintained urged still and can be prevented from moving in the widthwise direction with respect to the pair of side frames 12, 13. In other words, the wire-electrodes 210 may serve as springs, which can restrain the drawer 60 from moving in the widthwise direction with respect to the side frames 12, 13. Therefore, compared to a color printer, which has springs to restrain the drawer 60 from moving in the widthwise direction and the wire-electrodes 210 separately, a quantity of components to be used in the color printer 1 can be reduced.

In this regard, with the wire-electrodes 210 functioning as the springs to restrain the drawer 60 from moving in the widthwise direction, the substrate 100 may be subject to reaction force from the wire-electrodes 210. However, in the color printer 1 according to the present embodiment, the wire-electrodes 210 are arranged in the positions substantially apart from the center C. Therefore, the load from the reaction force from the wire-electrodes 210 to be applied to the central area in the substrate 100 can be reduced.

According to the color printer 1 described above, the processing units 50 along with the drawer 60 is arranged on the opposite side from the substrate 100 across the side frame 12. Therefore, when the drawer 60 is moved with respect to the side frames 12, 13 in the front-rear direction, the drawer 60 is prevented from being interfered with by the substrate 100.

Although an example of carrying out the invention has been described, those skilled in the art will appreciate that there are numerous variations and permutations of the color printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the beam 300 may not necessarily be formed to have the cross-sectional shape of "L" but may be formed to have a cross-sectional shape of, for example, "T". For another example, the beam 300 may not necessarily be arranged to longitudinally align along the vertical direction, which is orthogonal to the front-rear direction, but may be, for example, arranged to align along a direction to diagonally intersect with the front-rear direction.

For another example, the beam 300 may not necessarily be arranged in the position between the second wire-electrode 212 and the third wire-electrode 213 but may be, for example, arranged in a position between the third wire-electrode 213 and the fourth wire-electrode 214. Alternatively, if the side frame 12 is substantially rigid, the beam 300 may even be omitted.

For another example, the processing unit 50 may not necessarily include the photosensitive drum 51, the charger 52, and the developer cartridge 53, but the developer cartridge 53 may be omitted from the processing unit 50. For another example, the processing unit 50 may be equipped with a transfer roller in addition to the photosensitive drum 51, the charger, and the developer cartridge 53. Further, the configurations of the charger 52 and the developer cartridge 53 may not necessarily be limited to those described above in the embodiment. For example, the charger 52 may not necessarily be equipped with the grid. For another example, the chargers 52 may be equipped with a needle electrode to charge the photosensitive drum 51 in place of the charging wire 52A.

For another example, the configuration of the side frame 12 may not necessarily be limited to that described above in the embodiment. For example, the side frame 12 may not necessarily be formed to have the engageable parts 17A to support the substrate 100 but may be formed to have supporting structures similar to the fixing parts 16. Further, the side frame 12 may be formed to have the supporting structures on the same side as the image forming device 30. In other words, the side frame 12 may be configured to support the substrate 100 on the same side as the image forming device 30 is supported.

For another example, the configuration of the spring electrodes 200 may not necessarily be limited to that described above in the embodiment. For example, the spring electrodes 200 may not necessarily include the compression coiled springs but may include, for example, blade springs or torsion springs. Likewise, the feeder members 63 may include blade springs or torsion springs as well.

For another example, the color printer 1 may not necessarily be equipped with the drawer 60 to support the processing units 50, but the processing units 50 may be supported by the side frames 12, 13 directly without the drawer 60. In this regard, while the drawer 60 in the above-described embodiment is equipped with the receiving terminals 61, 62, the feeder members 63, and the conductive sheets 64, the terminals 52E are arranged in the identical positions among the processing units 50. However, when the drawer 60 is omitted, and the processing units 50 are directly supported by the side frames 12, 13, the position of the terminal 52E in each processing unit 50 may vary depending on the position of the corresponding spring electrodes 200.

For another example, the embodiment described above may not necessarily be applied to a color printer but may be employed in, for example, a copier and a multifunction peripheral device having an image readable device such as a flatbed scanner. For another example, the quantity of the processing units 50 may not necessarily be limited to four, but the embodiment described above may be employed in an image forming apparatus having three (3) or more processing units.

What is claimed is:

1. An image forming apparatus, comprising:

at least three image forming units, each of which comprises a photosensitive drum configured to be rotatable about a rotation axis, the photosensitive drums of the at least three image forming units being arranged to align along an aligning direction, which is orthogonal to the rotation axes of the photosensitive drums;

a substrate arranged on one side of the at least three image forming units in an axial direction of the rotation axes of the photosensitive drums, the substrate being configured to supply electricity to the at least three image forming units;

a frame made of resin and configured to support the at least three image forming units and the substrate; and a plurality of spring electrodes, each of which is provided to one of the at least three image forming units respectively, each of the plurality of spring electrodes being arranged in a position between the respective one of the at least three image forming units and the substrate in a compressed condition, wherein the plurality of spring electrodes comprises a first spring electrode, a second spring electrode arranged to adjoin the first spring electrode, and a third spring electrode arranged to adjoin the second spring electrode on a side opposite from the first spring electrode across the second spring electrode;

wherein the first spring electrode, the second spring electrode, and the third spring electrode are configured to serve a common function and are arranged to align along the aligning direction;

wherein the frame comprises a pair of supporting parts, each of which is arranged on one side and the other side of the plurality of spring electrodes along the aligning direction respectively, the pair of supporting parts being configured to support the substrate;

wherein a distance between the second spring electrode and the third spring electrode is greater than a distance between the first spring electrode and the second spring electrode;

wherein a center between the pair of supporting parts is located in a position between the second spring electrode and the third spring electrode;

wherein the frame is configured to support ends of the at least three image forming units on the one side in the axial direction on a first face thereof;

wherein the pair of supporting parts are formed on a second face of the frame, the second face being opposite from the first face, to support the substrate on one side of the frame;

wherein the image forming apparatus further comprises:

a beam made of a metal, the beam being formed in an elongated shape and fixed to the second face of the frame on the same one side of the frame as the substrate; and wherein the beam is arranged in a position between the second spring electrode and the third spring electrode along the aligning direction.

2. The image forming apparatus according to claim 1, wherein the beam is formed to have a first section, which spreads along the second face of the frame, and a second section, which spreads from the first section in a direction to be apart from the frame; and wherein the second section is arranged in a position between the second spring electrode and the third spring electrode along the aligning direction.

3. The image forming apparatus according to claim 1, further comprising:

a drawer configured to support the at least three image forming units, the drawer being movable along the aligning direction with respect to the frame, wherein the drawer comprises a plurality of receiving terminals, which are arranged to align along the aligning direction in positions corresponding to positions of the plurality of spring electrodes, the plurality of receiving terminals being electrically connectable with the plurality of spring electrodes in the corresponding positions.

4. The image forming apparatus according to claim 3, wherein the drawer comprises:

a plurality of feeder terminals arranged at equal intervals from one another along the aligning direction in positions corresponding to the at least three image forming units, each of the plurality of feeder terminals being electrically connectable with an electrode provided in a corresponding one of the at least three image forming units; and at least one intermediate conductor configured to electrically connect at least one of the plurality of receiving terminals with at least one of the plurality of feeder terminals.

5. The image forming apparatus according to claim 1, wherein each of the plurality of spring electrodes comprises a compression coiled spring.

6. The image forming apparatus according to claim 1, wherein each of the at least three image forming units comprises a charger configured to electrically charge the respective photosensitive drum; and wherein the first spring electrode, the second spring electrode, and the third spring electrode are configured to supply electricity to the chargers in the at least three image forming units respectively.

7. The image forming apparatus according to claim 1, wherein each of the at least three image forming units comprises a developer device configured to supply a developer agent to the respective photosensitive drum; and wherein the first spring electrode, the second spring electrode, and the third spring electrode are configured to supply electricity to the developer devices in the at least three image forming units respectively.

8. An image forming apparatus, comprising:

at least three image forming units, each of which comprises a photosensitive drum configured to be rotatable about a rotation axis, the photosensitive drums of the at least three image forming units being arranged to align along an aligning direction, which is orthogonal to the rotation axes of the photosensitive drums;

a substrate arranged on one side of the at least three image forming units in an axial direction of the rotation axes of the photosensitive drums, the substrate being configured to supply electricity to the at least three image forming units;

a frame configured to support the at least three image forming units and the substrate; and a plurality of spring electrodes, each of which is provided to one of the at least three image forming units respectively, each of the plurality of spring electrodes being arranged in a position between the respective one of the at least three image forming units and the substrate in a compressed condition, wherein the plurality of spring electrodes comprise a first spring electrode, a second spring electrode arranged to adjoin the first spring electrode, and a third spring electrode arranged to adjoin the second spring electrode on a side opposite from the first spring electrode across the second spring electrode, wherein the first spring electrode, the second spring electrode, and the third spring electrode are configured to serve a common function and are arranged to align along the aligning direction, wherein the frame comprises a pair of supporting parts, each of which is arranged on one side and the other side of the plurality of spring electrodes along the aligning direction respectively, the pair of supporting parts being configured to support the substrate, wherein a distance between the second spring electrode and the third spring electrode is greater than a distance between the first spring electrode and the second spring electrode; and wherein a center between the pair of supporting parts is located in a position between the second spring electrode and the third spring electrode, wherein each of the at least three image forming units comprises a charger configured to electrically charge the respective photosensitive drum, and wherein the first spring electrode, the second spring electrode, and the third spring electrode are configured to supply electricity to the chargers in the at least three image forming units respectively.

9. The image forming apparatus according to claim 8, further comprising:

a drawer configured to support the at least three image forming units, the drawer being movable along the aligning direction with respect to the frame, wherein the drawer comprises a plurality of receiving terminals, which are arranged to align along the aligning direction in positions corresponding to positions of the plurality of spring electrodes, the plurality of receiving terminals being electrically connectable with the plurality of spring electrodes in the corresponding positions.

10. The image forming apparatus according to claim 9, wherein the drawer comprises:

a plurality of feeder terminals arranged at equal intervals from one another along the aligning direction in positions corresponding to the at least three image forming units, each of the plurality of feeder terminals being electrically connectable with an electrode provided in a corresponding one of the at least three image forming units; and at least one intermediate conductor configured to electrically connect at least one of the plurality of receiving terminals with at least one of the plurality of feeder terminals.

11. The image forming apparatus according to claim 8, wherein each of the plurality of spring electrodes comprises a compression coiled spring.

12. An image forming apparatus, comprising:

at least three image forming units, each of which comprises a photosensitive drum configured to be rotatable about a rotation axis, the photosensitive drums of the at least three image forming units being arranged to align along an aligning direction, which is orthogonal to the rotation axes of the photosensitive drums;

a substrate arranged on one side of the at least three image forming units in an axial direction of the rotation axes of the photosensitive drums, the substrate being configured to supply electricity to the at least three image forming units;

a frame configured to support the at least three image forming units and the substrate; and a plurality of spring electrodes, each of which is provided to one of the at least three image forming units respectively, each of the plurality of spring electrodes being arranged in a position between the respective one of the at least three image forming units and the substrate in a compressed condition, wherein the plurality of spring electrodes comprise a first spring electrode, a second spring electrode arranged to adjoin the first spring electrode, and a third spring electrode arranged to adjoin the second spring electrode on a side opposite from the first spring electrode across the second spring electrode, wherein the first spring electrode, the second spring electrode, and the third spring electrode are configured to serve for a common function and are arranged to align along the aligning direction, wherein the frame comprises a pair of supporting parts, each of which is arranged on one side and the other side of the plurality of spring electrodes along the aligning direction respectively, the pair of supporting parts being configured to support the substrate, wherein a distance between the second spring electrode and the third spring electrode is greater than a distance between the first spring electrode and the second spring electrode, wherein a center between the pair of supporting parts is located in a position between the second spring electrode and the third spring electrode, wherein each of the at least three image forming units comprises a developer device configured to supply a developer agent to the respective photosensitive drum, and wherein the first spring electrode, the second spring electrode, and the third spring electrode are configured to supply electricity to the developer devices in the at least three image forming units respectively.

13. The image forming apparatus according to claim 12, further comprising:

a drawer configured to support the at least three image forming units, the drawer being movable along the aligning direction with respect to the frame, wherein the drawer comprises a plurality of receiving terminals, which are arranged to align along the aligning direction in positions corresponding to positions of the plurality of spring electrodes, the plurality of receiving terminals being electrically connectable with the plurality of spring electrodes in the corresponding positions.

14. The image forming apparatus according to claim 13, wherein the drawer comprises:

a plurality of feeder terminals arranged at equal intervals from one another along the aligning direction in positions corresponding to the at least three image forming units, each of the plurality of feeder terminals being electrically connectable with an electrode provided in a corresponding one of the at least three image forming units; and at least one intermediate conductor configured to electrically connect at least one of the plurality of receiving terminals with at least one of the plurality of feeder terminals.

15. The image forming apparatus according to claim 12, wherein each of the plurality of spring electrodes comprises a compression coiled spring.

* * * * *